United States Patent [19]

Hsieh

[11] Patent Number: 4,928,565

[45] Date of Patent: May 29, 1990

[54] MUSICAL DRUM WITH PRESSURE BUFFER ELEMENT

[76] Inventor: Wu H. Hsieh, No. 178, Chung Shan Erh Rd., Lu Chou Hsiang, Taipei Hsien, Taiwan

[21] Appl. No.: 406,400

[22] Filed: Sep. 12, 1989

[51] Int. Cl.[5] ..... G10D 13/02

[52] U.S. Cl. ..... 84/411 R; 84/413

[58] Field of Search ..... 84/411–420

[56] References Cited

U.S. PATENT DOCUMENTS

| | | | |
|---|---|---|---|
| 1,420,233 | 6/1922 | Baldwin et al. | 84/411 R |
| 3,818,791 | 6/1974 | Zickos | 84/411 R |
| 4,060,018 | 11/1977 | Gilbrech | 84/269 |
| 4,295,405 | 10/1981 | Sleishman | 84/413 |
| 4,475,434 | 10/1984 | Willis | 84/411 R |
| 4,619,179 | 10/1986 | Wright | 84/413 |
| 4,833,964 | 5/1989 | Prouty | 84/411 R |
| 4,869,146 | 9/1989 | Bonsor | 84/413 |

FOREIGN PATENT DOCUMENTS

| | | | |
|---|---|---|---|
| 3503866 | 10/1985 | Fed. Rep. of Germany | 84/411 R |

*Primary Examiner*—Lawrence R. Franklin

*Attorney, Agent, or Firm*—Browdy and Neimark

[57] ABSTRACT

A musical drum with a drum face, a wooden drum body and a buffer element. The buffer element is situated between the drum face and the drum body. The drum face includes a drumhead and a rim for clamping the drumhead across the buffer element by way of clamping screws. The pressure exerted by the drum head on the buffer element is absorbable by the buffer element.

1 Claim, 2 Drawing Sheets

MUSICAL DRUM WITH PRESSURE BUFFER ELEMENT

BACKGROUND OF THE INVENTION

This invention relates to a musical drum, and particularly to an improved body design which prevents deformation of the wooden drum body due to the pressure exerted by the stretching of the drumhead across the drum body.

A drum's percussional tone ensues when the drumhead is beaten. A particular percussional tone is derived by maintaining a certain tension in the drumhead. This tension is achieved when the drumhead is stretched over the upper brim of the drum body and clamped under a rim. Clamping screws pass through the rim and screw into threaded receptacles mounted on the side of the drum body. When the clamping screws are tightened, the rim clamps the drumhead down, stretching it across the drum body. Unfortunately, the pressure exerted by the drumhead on the wooden body can deform the wooden body which in turn affects the tension maintained across the drumhead causing aberration in the percussional tone.

It is the purpose of this present invention, therefore, to mitigate and/or obviate the above-mentioned drawbacks in the manner set forth in the detailed description of the preferred embodiment.

SUMMARY OF THE INVENTION

A primary objective of this invention is to provide an improved drum design wherein the drumhead is prevented from exerting an excess of pressure on the wooden drum body.

Further objectives and advantages of the present invention will become apparent as the following description proceeds, and the features of novelty which characterize the invention are pointed out with particularity in the claims annexed to and forming a part of this invention.

DETAILED DESCRIPTION OF THE PREFERRED EMBODIMENT

Figure 1:
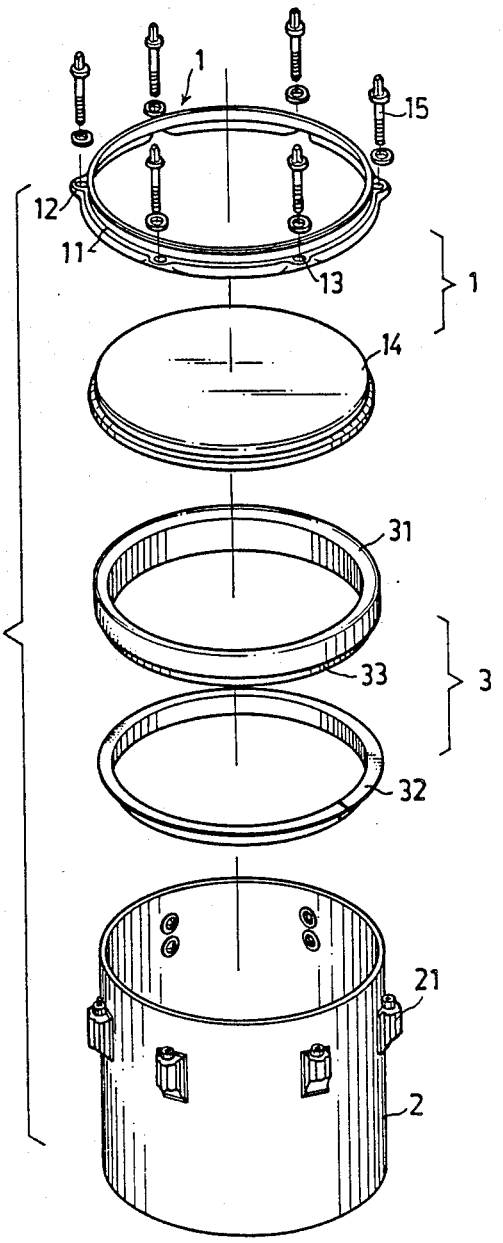
FIG. 1 is an exploded view of a drum in accordance with the present invention.
Figure 2:
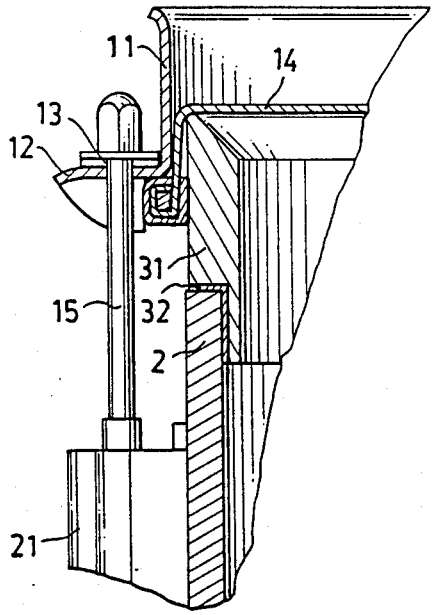
FIG. 2 is a sectional view of a drumhead clamping system in accordance with the present invention.

Referring to FIG. 1 and FIG. 2, it can be seen that a drum in accordance with the present invention comprises a drum face (1), a wooden drum body (2), and a buffer element (3).

The buffer element (3) is positioned between the drum face (1) and the wooden drum body (2) in order to provide a pressure-absorbing element between the drum face (1) and the wooden drum body (2). Deformation of the wooden drum body (2) due to pressure exerted on the drum body (2) during clamping is thereby prevented.

Referring to FIG. 1, then, it can be seen that the drum face (1) essentially comprises a rim (11) and a drumhead (14). With reference, now, to FIG. 2, it can further be seen that the rim (11) serves to clamp the drumhead (14) to the buffer element (3) in such a way that a specific tension is maintained across the drumhead (14) which produces a particular percussional tone when the drumhead (14) is beaten.

The rim (11) subsequently comprises a metal lip which fits around the outside of the brim of the drum body (2) in order to clamp the drumhead (14) to the buffer element (3). The rim (11) further comprises a plurality of tabs (12) equally spaced around the outer lip of the rim (11). Through each tab (12) is a hole (13) through which a respective clamping screw (15) passes. The clamping screws (15) are screwed into threaded receptacles (21) in order to pull the rim (11) downward clamping the drumhead (14) to the buffer element (3) which is disposed on the drum body (2) The tightening of the clamping screws (15) then causes the drumhead (14) to exert a pressure on the buffer element (3).

The buffer element (3) comprises a metal ring (31) on the underside of which is cut a concavity (33) for receiving the upper brim of the drum body (2). The buffer element (3) further comprises a flexible washer (32) which fits into the concavity (33) and is disposed between the metal ring and the drum body (2). Therefore, the tightening of the clamping screws (15) causes the drumhead (14) to exert a pressure on the metal ring (31) of the buffer element (3) which in turn exerts a pressure on the flexible washer (32). This pressure is absorbable by the flexible washer (32) such that deformating of the wooden drum body (2) is prevented.

As various possible embodiments might be made of the above invention without departing from the scope of the invention, it is to be understood that all matter herein described or shown in the accompanying drawing is to be interpreted as illustrative and not in a limiting sense. Thus it will be appreciated that the drawings are exemplary of a preferred embodiment of the invention.

I claim:

1. A musical drum with a buffer element substantially comprising drumface (1), a wooden drum body (2) and a buffer element (3), wherein:

said buffer element (3) is disposed between said drum face (1) and said wooden drum body (2);

said drum face (1) comprises a drumhead (14) and a rim (11) for the purpose of clamping said drumhead (14) to said buffer element (3); said rim (11) further comprises an outer lip on which is disposed a plurality of equally spaced tabs (12); through each respective tab (12) is a hole (13) through which a respective clamping screw (15) is passable; said buffer element (3) comprises a metal ring (31) on the outside bottom edge of which is cut a concavity (32) for receiving a brim of the drum body (2); said buffer element (3) further comprises a flexible washer (32) which fits into the concavity (31) and is disposed between the metal ring (31) of the buffer element (3) and said brim of the drum body (2); a downward pressure exerted on the buffer element (3) by the stretching of the drumhead (14) across said buffer element, due to the tightening of said clamping screws (15) is absorbable by said flexible washer (32) thereby preventing deformation of the wooden drum body (2).

* * * * *